US010166555B2

(12) United States Patent
Lin et al.

(10) Patent No.: US 10,166,555 B2
(45) Date of Patent: Jan. 1, 2019

(54) WATER JET DEVICE FOR ROTARY MASSAGE

(71) Applicants: Xiaofa Lin, Nan'an (CN); Xiaoshan Lin, Nan'an (CN); Qiqiao Liu, Nan'an (CN); Xiaoqing Deng, Nan'an (CN); Jun Xu, Nan'an (CN)

(72) Inventors: Xiaofa Lin, Nan'an (CN); Xiaoshan Lin, Nan'an (CN); Qiqiao Liu, Nan'an (CN); Xiaoqing Deng, Nan'an (CN); Jun Xu, Nan'an (CN)

(73) Assignee: Fujian Xihe Sanitary Ware Technology Co., Ltd., Nan'an (CN)

( * ) Notice: Subject to any disclaimer, the term of this patent is extended or adjusted under 35 U.S.C. 154(b) by 6 days.

(21) Appl. No.: 15/412,060

(22) Filed: Jan. 23, 2017

(65) Prior Publication Data

US 2017/0128963 A1 May 11, 2017

(30) Foreign Application Priority Data

Aug. 31, 2016 (CN) ..... 2016 1 0789355

(51) Int. Cl.
*B05B 1/06* (2006.01)
*B05B 3/04* (2006.01)

(52) U.S. Cl.
CPC ..... *B05B 3/0422* (2013.01); *B05B 1/06* (2013.01); *B05B 3/04* (2013.01); *B05B 3/045* (2013.01); *B05B 3/0427* (2013.01)

(58) Field of Classification Search
CPC ..... B05B 3/0422; B05B 1/18; B05B 3/04; B05B 3/0427; B05B 1/12
USPC ..... 239/240, 381, 383, 222.15, 222.17, 263
See application file for complete search history.

(56) References Cited

U.S. PATENT DOCUMENTS 2,878,066 A * 3/1959 Erwin ..... B05B 1/3426 239/381
3,485,451 A * 12/1969 Gore ..... B05B 3/0427 239/383
3,568,716 A * 3/1971 Heitzman ..... B05B 1/1636 137/599.08
3,759,290 A * 9/1973 D'Alba ..... B60S 1/48 137/565.17
4,101,075 A * 7/1978 Heitzman ..... B05B 3/04 239/101
4,848,662 A * 7/1989 Shevach ..... B05B 3/04 239/237

(Continued)

*Primary Examiner* — Jason J Boeckmann
*Assistant Examiner* — Steven M Cernoch

(57) ABSTRACT

A water jet device for rotary massage includes a seat providing an outlet and a cavity; a cover providing an inlet; a separating member, a rotary shaft, an impeller and a rotor received in the cavity; at least one inclined water ejection port disposed on the separating member and communicating with the inlet; the impeller is mounted between the rotor and the separating member; the rotor is in the outlet, a plurality of curved grooves are formed on the periphery of the rotor; a track assembly includes an annular rail having ascending and descending sections formed on an inner bottom of the seat, and sliders formed on an underside of the impeller; water flowing through the water ejection port rotates the impeller, further drives the rotor to rotate, and the fluctuation of the impeller and the rotor drives the water fluctuates, thus form intermittent and dynamic annular water sprays.

3 Claims, 10 Drawing Sheets

(56) References Cited

U.S. PATENT DOCUMENTS

| | | | | |
|---|---|---|---|---|
| 5,415,130 | A * | 5/1995 | Brackett | A01J 7/04 119/670 |
| 6,193,169 | B1 * | 2/2001 | Steinhilber | B05B 3/003 239/240 |
| 6,991,362 | B1 * | 1/2006 | Seaman | B01F 5/0218 239/240 |
| 7,546,959 | B2 * | 6/2009 | Wagner | B05B 3/003 239/251 |
| 7,584,906 | B2 * | 9/2009 | Lev | B05B 1/18 239/222.15 |
| 8,297,534 | B2 * | 10/2012 | Li | B05B 1/1654 239/222.11 |
| 8,403,240 | B2 * | 3/2013 | Chen | B05B 3/0422 239/240 |
| 9,067,222 | B2 * | 6/2015 | Gransow | B05B 1/18 |
| 9,815,070 | B2 * | 11/2017 | Lin | B05B 1/267 |
| 2006/0144968 | A1 * | 7/2006 | Lev | B05B 1/18 239/590 |
| 2007/0205309 | A1 * | 9/2007 | Zhou | B05B 3/0427 239/587.1 |

* cited by examiner

WATER JET DEVICE FOR ROTARY MASSAGE

BACKGROUND OF THE INVENTION

1. Field of the Invention

The invention relates to the sanitary industry, in particular to a water jet device for rotary massage.

2. Description of Related Art

The water jet pattern of most existing water jet devices is relatively single, such as separate water particles, cylindrical water and the like. For this reason, the designers make various improvements to combine multiple water jet patterns, for example, Chinese patent publication No. CN103028499B entitled "Reciprocating Mechanism for Water Jet device" which utilizes a reciprocating mechanism to combine and switch multiple water jet patterns to achieve a better massage effect. However, the water jet device disclosed in the publication presents a complicated mechanism involving many components, such as gear assemblies, helical worms and the like. Due to a confined space of the water jet device, it's difficult to assemble the complicated mechanism, and this may increase the cost of assembly. Furthermore, the water jet device may suffer from failure during use. Because the accumulated scale forming after being used for a period of time may affect the components, and make it impossible to realize a discretionary functions switching. Moreover, its weight is increased greatly due to the excessive number of components. Water flow additionally adds to the weight in showering operation. Thus, the product manufactured based on the publication does not enjoy market success. Further, spray pattern is changed by means of a reciprocating mechanism so as to bring out a massaging effect to an individual taking a shower. This cannot satisfy ordinary users who desire a water jet device capable of providing a water particle spray under one pattern with better massaging effects. Therefore, it is desirable to provide an improved water jet device which addresses the above described problems.

SUMMARY OF THE INVENTION

It is therefore an object of the invention to provide a seat providing at least one outlet and a cavity; a cover providing an inlet; a separating member providing at least one inclined water ejection port communicating with the inlet; a rotary shaft; an impeller providing water channels formed between the blades of the impeller; a rotor providing a plurality of curved grooves formed on an outer surface; wherein the separating member, the rotary shaft, the impeller and the rotor are received in the cavity; the impeller is mounted between the rotor and the separating member via the rotary shaft; the rotor is disposed in the outlet below the impeller; water flowing through the water ejection port rotates the impeller, further drives the rotor to rotate, thus water sprays out of curved grooves in water particles of annular pattern.

Preferably, the water jet device includes a track assembly and the track assembly comprises a discontinuous rail formed on an inner bottom of the seat, and a plurality of sliders formed on an underside of the impeller; the discontinuous rail has ascending and descending sections, the sliders are configured to move along the discontinuous rail; the impeller rotates and the sliders ascend and descend along the discontinuous rail intermittently or periodically, and water flowing through the impeller fluctuates, thus forming intermittent water particles spraying out of the curved grooves.

Preferably, the impeller and the rotor are either secured together or formed integrally; the rotation and the fluctuation of the impeller drives the rotor to ascend and descend, thus changing a distance between the inclined curved grooves and the mouth of the outlet, thus enlarging or reducing the annular area of the water sprays accordingly.

Preferably, the outlet has an inner diameter of 2-12 mm, and a distance between the mouth of the outlet and the curved grooves is 2.5-8 mm.

Preferably, the water separating member is provided thereon with at least one outwards extending protrusion, and an inclined water ejection port is formed passing through each protrusion.

Preferably, the inclined water ejection port each is tapered toward the seat.

Compared to the prior art, the invention has the following advantages:

(1) The invention has a simple structure, few components and wide applicability. In response to the rotation of the impeller, the rotor rotates, thus water particles in annular pattern are sprayed out from the curved grooves; furthermore, the size of the water particles and the annular area of the spray changes intermittently along with the movement of the impeller and the rotor enabling a better massage effect.

(2) The rotor rotates along with the impeller, and the water particles sprayed from the curved groove dashes on the inner wall of the outlet, thus forming more visualized water particles; the aforesaid effect is realized through a simple structure, thus more suitable for products with limited space.

(3) The impeller fluctuates during rotation via the track assembly, further drives the water to fluctuate and changes the water flow accordingly, thus forming intermittent and dynamic water particles; compared with the driving mechanisms such as gear, worm wheel, worm screw and the like in the prior art, the track assembly is simpler, has a better performance and is easier to assemble.

(4) The rotor and the impeller are either secured together or formed integrally; the fluctuation of the impeller drives the rotor to ascend and descend in the outlet, thus changing the distance between the curved grooves and the mouth of the outlet and enlarging or reducing the annular area of the water sprays accordingly for a better massage experience.

(5) The diameter of the outlet is 2-12 mm, and a distance from the mouth of the outlet to the curved grooves is 2.5-8 mm; tests show that the interaction between the outlet and the track assembly in the above interval ranges ensures an optimum performance of the water sprays. Water particles from the water flow provide an optimum massage effect.

(6) The invention is provided with at least one protrusion on the separating member, and the water ejection port is formed in the protrusion, thus extending the water passage and improving the water flow.

(7) The water ejection port is tapered toward the seat. The tapered design of the water ejection port along with the lengthened water passage increases the flow rate.

The above and other objects, features and advantages of the invention will become apparent from the following detailed description taken with the accompanying drawings.

DETAILED DESCRIPTION OF THE INVENTION

Figure 1:
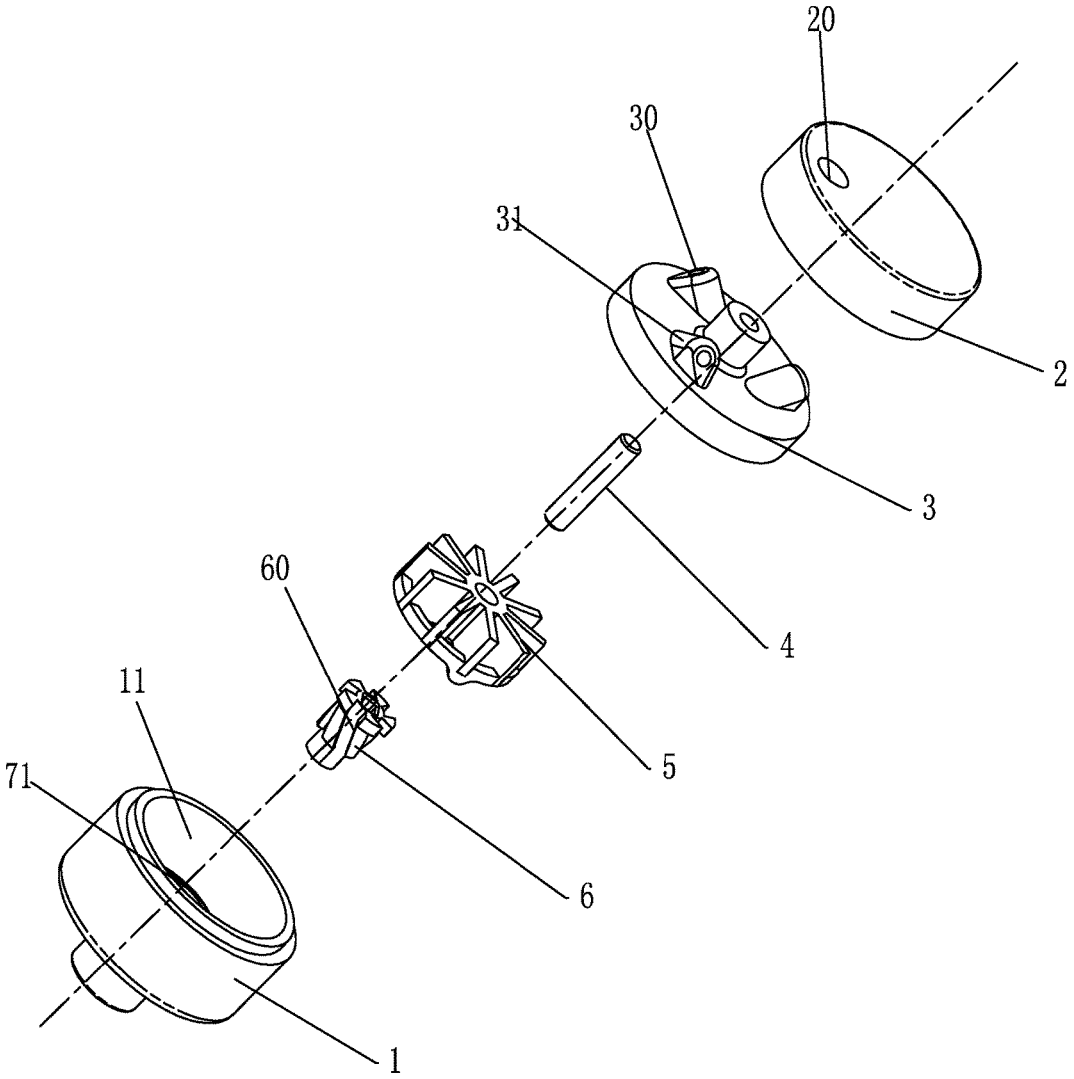
FIG. 1 is an exploded view of a water jet device according to the invention.
Figure 2:
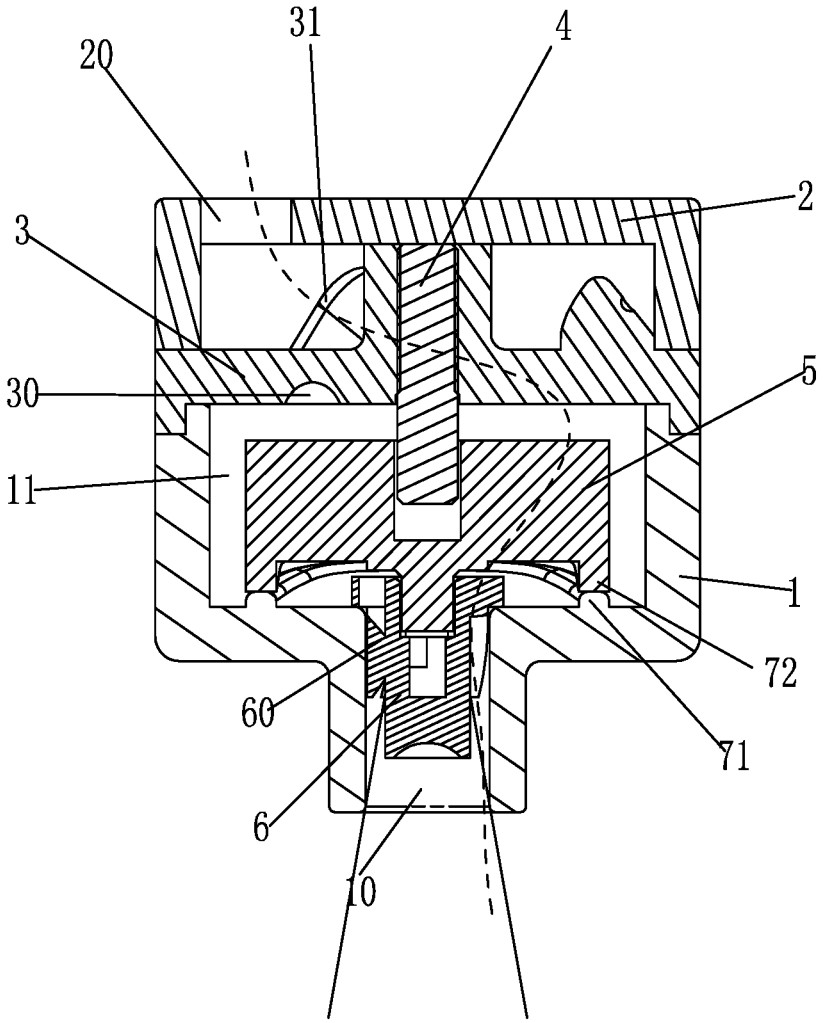
FIG. 2 is a longitudinal sectional view of the assembled water jet device.
Figure 3:
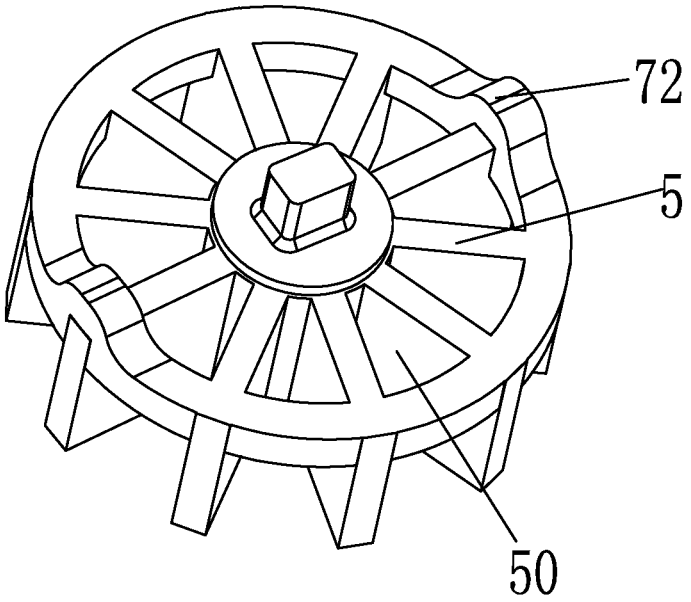
FIG. 3 is a perspective view of the impeller.
Figure 4:
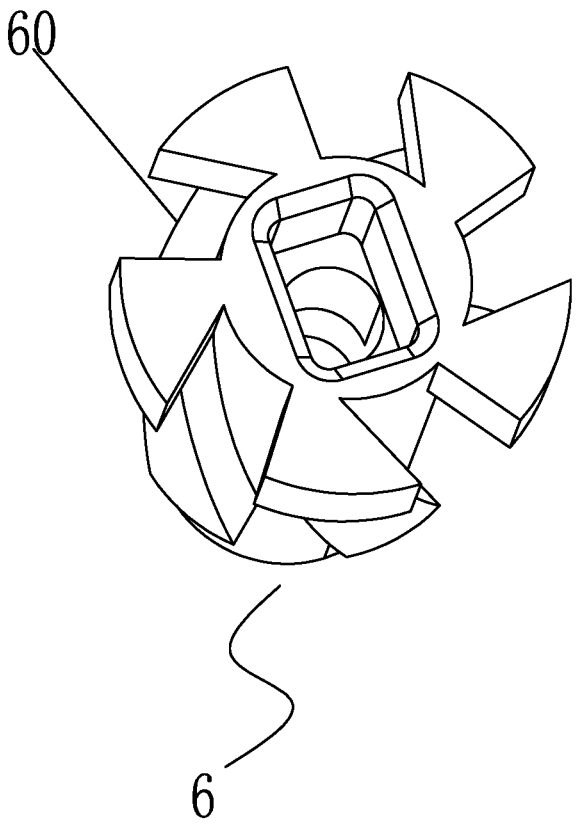
FIG. 4 is a perspective view of the rotor.
Figure 5:
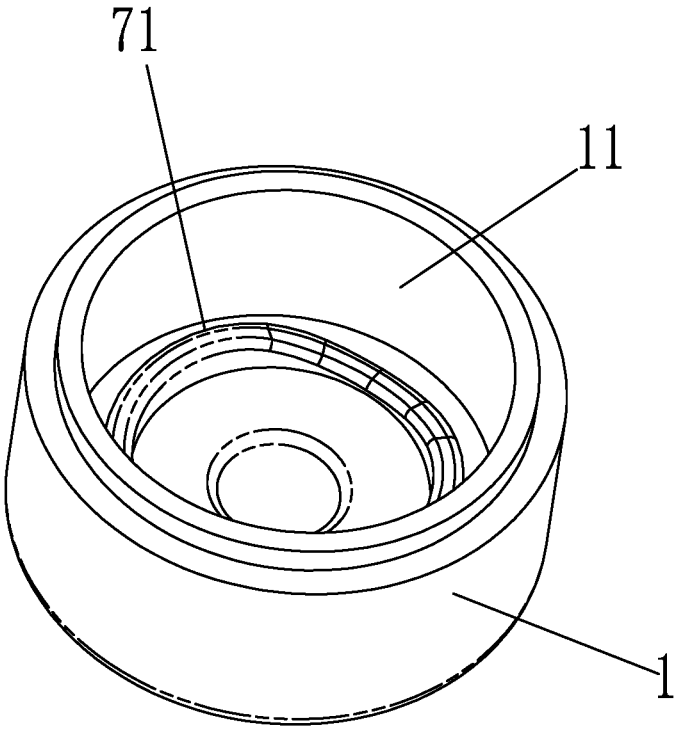
FIG. 5 is a perspective view of the seat.
Figure 6:
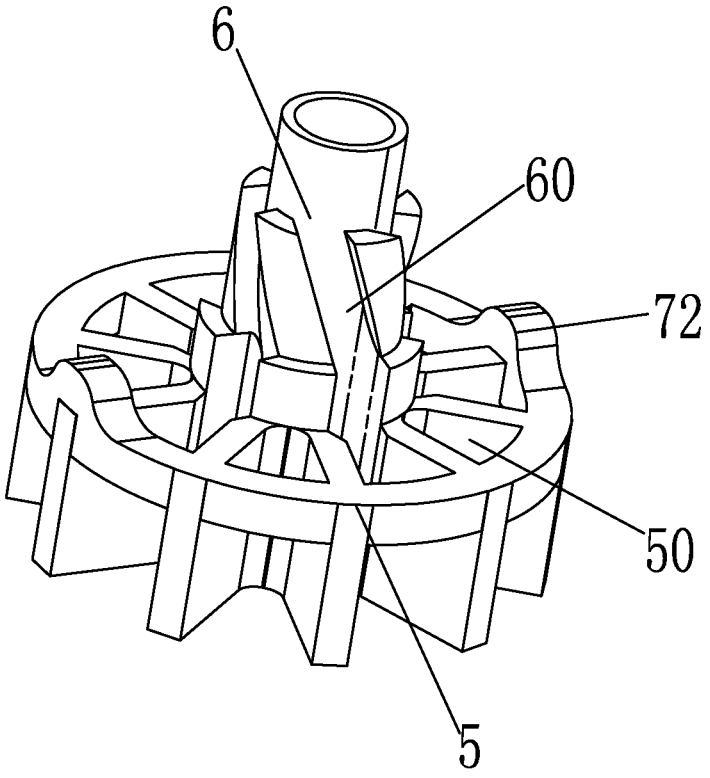
FIG. 6 is a perspective view of the rotor and the impeller in an assembled state.

Referring to FIGS. 1 to 6, a water jet device for rotary massage in accordance with the invention comprises a seat 1 providing at least one outlet 10 and a cavity 11; a cover 2 providing an inlet 20; a separating member 3, a rotary shaft 4, an impeller 5 and a rotor 6 received in the cavity 11;

at least one inclined water ejection port 30 disposed on the separating member 3 and communicating with the inlet 20; the water separating member 3 is provided thereon with at least one outwards extending protrusion 31, and an inclined water ejection port 30 is formed passing through each protrusion 31; the inclined water ejection port 30 each is tapered toward the impeller 5; the protrusion 31 lengthens the water passage; the tapered design of the water ejection port 30 along with the lengthened water passage increases the flow rate and the impact force of the water.

The impeller 5 is mounted between the rotor 6 and the separating member 3 via the rotary shaft 4, and water channels 50 are formed between the blades of the impeller 5;

The rotor 6 is disposed in the outlet 10 below the impeller 5, and a plurality of curved grooves 60 are formed on the outer surface of the rotor 6; the diameter of the outlet 10 is preferably 2-12 mm, and a distance from the mouth of the outlet 10 to the curved grooves 60 is preferably 2.5-8 mm;

Wherein the water flowing through the water ejection port 30 rotates the impeller 5, further drives the rotor 6 to rotate, thus water sprays out of curved grooves 60 in water particles of annular pattern.

Embodiment 1:

Embodiment 1 aims at providing intermittent and dynamic water sprays. The major components for the embodiment are as follows: a seat 1, a cover 2, a separating member 3, a rotary shaft 4, an impeller 5, and a rotor 6;

When in practical assembly, as shown in FIG. 1-5, firstly, the rotary shaft 4 is mounted in a center of the separating member 3; the cover 2 and the separating member 3 are welded to form a water inlet chamber;

Subsequently, the impeller 5 is sleeved on the rotary shaft 4;

Secondary, a track assembly 7 comprises an annular rail 71 formed on an inner bottom of the seat 1, and a plurality of sliders 72 formed on an underside of the impeller 5; the annular rail 71 has ascending and descending sections, and the sliders 72 are configured to move along the annular rail 71;

Thirdly, the rotor 6 is rotatably disposed in the outlet 10 of the seat 1, and curved grooves 60 formed on the outer surface of the rotor 6 are interacting with the inner wall of the outlet 10 to form water particles by throwing the water flowing through the rotating rotor 6 against the inner wall of the outlet 10;

Finally, the seat 1 and the cover 2 are connected together; the slider 72 on the impeller 5 urges against the annular rail 71 on the seat 1; the impeller 5 is releasably connected with the rotor 6.

Then the whole assembly process is complete.

Figure 7:
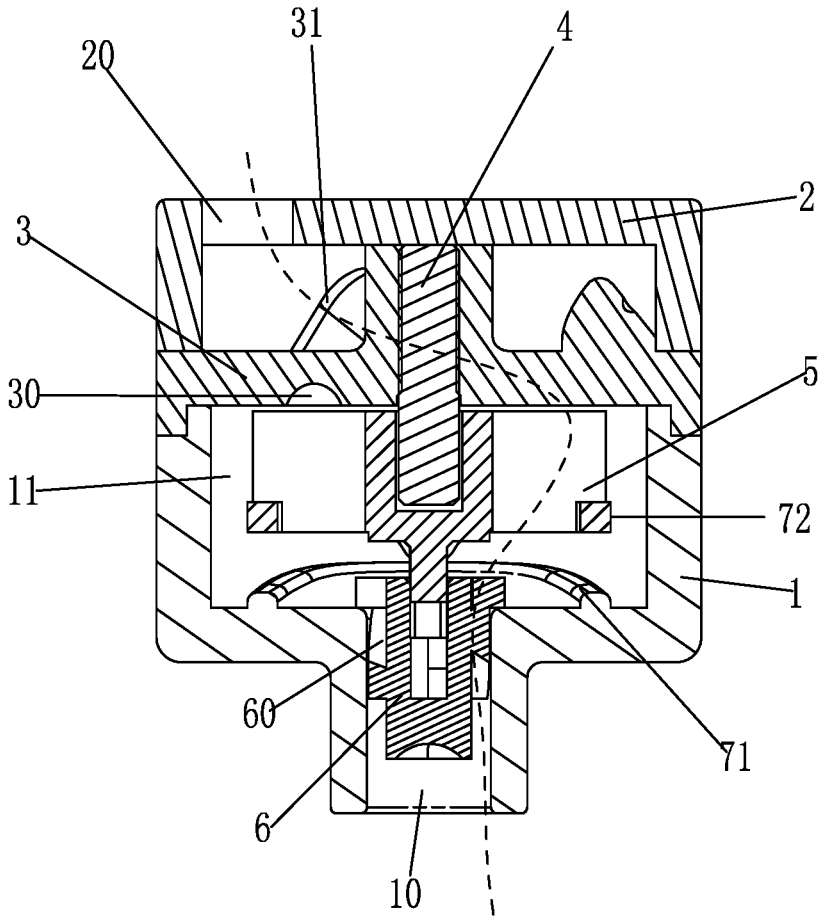
FIG. 7 is a longitudinal sectional view of a water jet device according to a first preferred embodiment of the invention.
Figure 8:
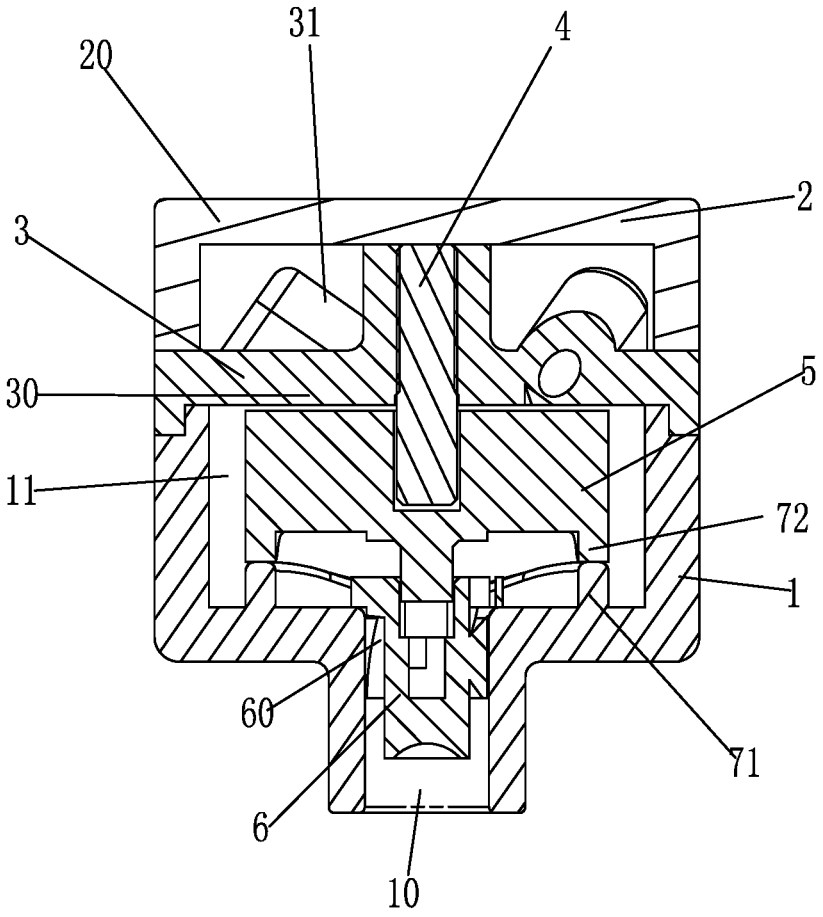
FIG. 8 is another longitudinal sectional view of the water jet device of FIG. 7.

Operation of the invention is described in detail below:

As shown in FIG. 7-8, water flows to the water inlet chamber via the inlet 20, then flows out from the water ejection port 30 of the separating member 3; thanks to the lengthened water passage and the tapered design of the water ejection port, water flow is greatly increased and the strong flow rotates the impeller 5, which in turn drives the rotor 6 to rotate; the water enters the curved grooves 60 via the water channels 50 formed between the blades of the impeller 5, such that the water flowing through the rotating rotor 6 is thrown against the inner wall of the outlet 10, thus forming water particles in annular pattern; in the meanwhile, while the impeller 5 rotates, the sliders 72 thereon are ascending and descending along the annular rail 71, which in turn drives the impeller 5 to fluctuate; since the impeller 5 and the rotor 6 are disposed separately, while the impeller 5 is rotating and fluctuating, the rotor 6 is rotating only; the fluctuation of the impeller 5 changes the water flow and the speed of the water flowing through the curved grooves 60: soft water particles are generated when the water flow is small, and intense water particles are generated when the water flow is large, thus forming the intermittent and dynamic annular water sprays.

Embodiment 2:

Embodiment 2 aims at providing a water spray in which the size of the water particles and the annular area changes intermittently; As shown in FIG. 1-6, the same part between Embodiment 2 and Embodiment 1 will not be repeated; the difference lies in: the impeller 5 and the rotor 6 are either secured together or formed integrally; the impeller 5 rotates about the rotary shaft (4) and fluctuates along the annular rail 71, and the rotor 6 is driven to ascend and descend, thus changing a distance between the curved grooves 60 and the mouth of the outlet 10 and enlarging or reducing the annular area of the water sprays accordingly.

Figure 9:
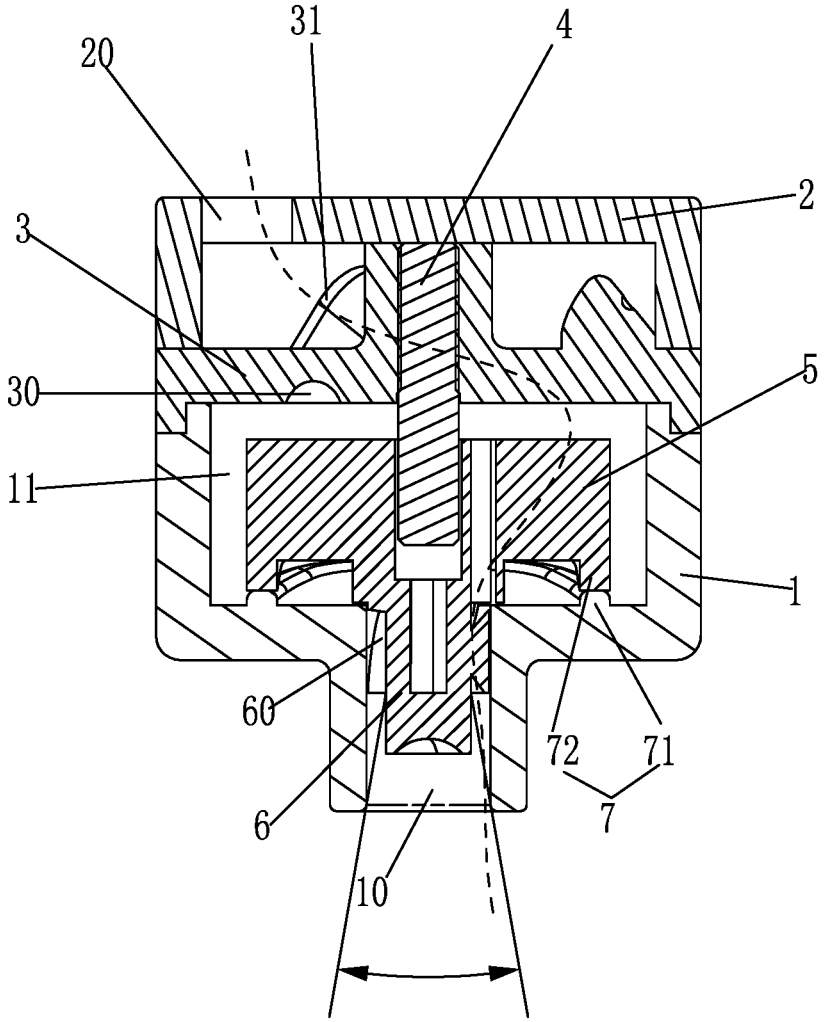
FIG. 9 is a longitudinal sectional view of a water jet device according to a second preferred embodiment of the invention.
Figure 10:
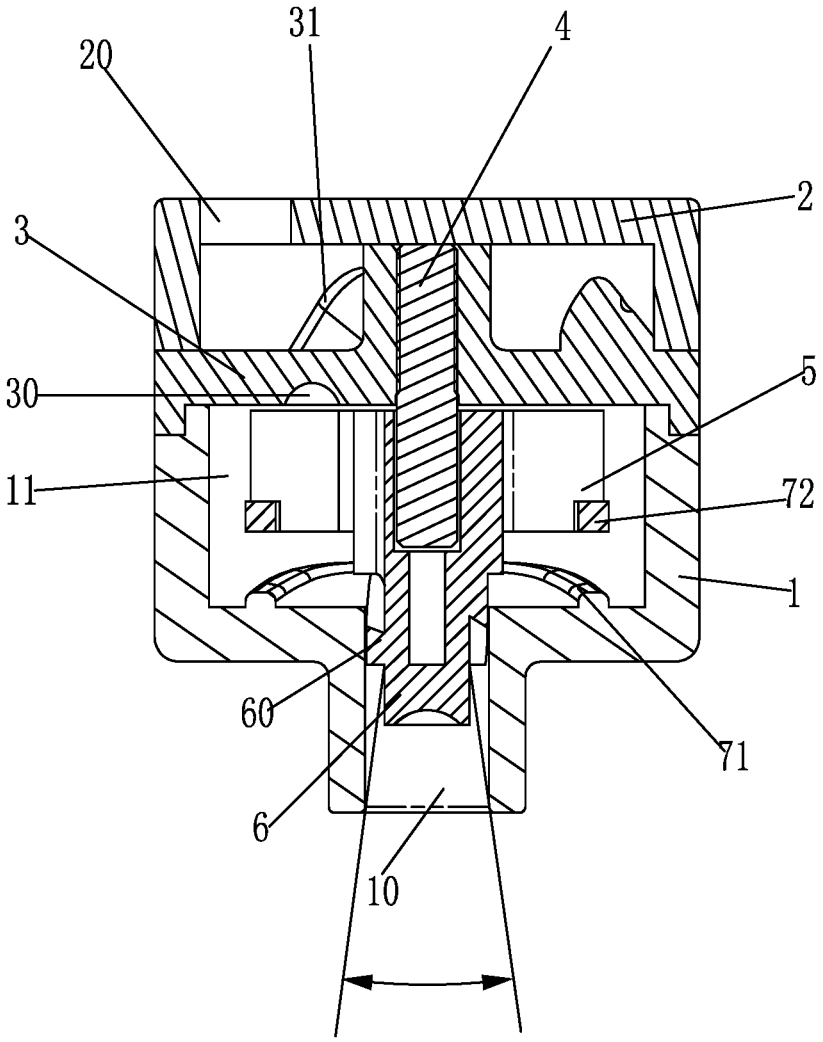
FIG. 10 is another longitudinal sectional view of the water jet device of FIG. 9.

Operation of the invention is described in detail below:

As shown in FIG. 9-10, the water flow direction is the same as that in Embodiment 1; the difference lies in: while the impeller 5 rotates and fluctuates, the rotor integrated to the impeller 5 also rotates and fluctuates, thus changing a distance between the curved groove 60 and the mouth of the outlet 10 and changing the annular area of the water sprays accordingly: while the rotor 6 ascends, the annular area of the water spray is smaller and the water particles are larger; while the rotor 6 descends, the annular area of the water spray is larger and the water particles are smaller; in the meanwhile, the water flow also changes constantly along with the water particles accordingly, thus providing a better massage experience.

(1) The invention has a simple structure, few components and wide applicability. In response to the rotation of the impeller, the rotor rotates, thus water particles in annular pattern are sprayed out from the curved groove; furthermore, the size of the water particles and the annular area of the spray changes intermittently along with the movement of the impeller and the rotor enabling a better massage effect; (2) The rotor rotates along with the impeller, such that the water particles sprayed from the curved groove dashes on the inner wall of the outlet, thus forming more visualized water particles; the aforesaid effect is realized through a foolproof structure, thus more suitable for products with limited space; (3) The impeller fluctuates during rotation via the track assembly, further drives the water to fluctuate and changes the water flow accordingly, thus forming intermittent and dynamic water particles; compared with the driving mechanisms such as gear, worm wheel, worm screw and the like in the prior art, the track assembly is simpler, has a better performance and is easier to assemble; (4) The rotor and the impeller are either secured together or formed integrally; the fluctuation of the impeller drives the rotor to ascend and descend in the outlet, thus changing the distance between the curved groove and the mouth of the outlet and enlarging or reducing the annular area of the water sprays accordingly for a better massage experience; (5) The diameter of the outlet is 2-12 mm, and a distance from the mouth of the outlet to the curved groove is 2.5-8 mm; tests show that the interaction between the outlet and the track assembly in the above interval ranges ensures an optimum performance of the water sprays. Water particles with a certain flow energy provide an optimum massage effect; (6) The invention is provided with at least one protrusion on the separating member, and the water ejection port is formed in the protrusion, thus extending the water passage and improving the water flow; (7) The water ejection port is tapered toward the seat. The tapered design of the water ejection port along with the lengthened water passage increases the flow rate.

While the invention has been described in terms preferred embodiments, those skilled in the art will recognize that the invention can be practiced with modifications within the spirit and scope of the appended claims.

What is claimed is:

1. A water jet device for rotary massage, comprising:

a seat (1) including at least one outlet (10) and a cavity (11);

a cover (2) including an inlet (20);

a separating member (3) including at least one inclined water ejection port (30) communicating with the inlet (20);

a rotary shaft (4);

an impeller (5) including a plurality of water channels (50) formed between blades of the impellers (5);

a rotor (6) including a plurality of curved grooves (60) formed on an outer surface;. and a track assembly (7) including an annular rail (71) having ascending and descending sections formed on a bottom of the cavity (11), and a plurality of sliders (72) formed on an underside of the impeller (5);

wherein the impeller (5) is disposed in the cavity (11) and mounted between the rotor (6) and the separating member (3) via the rotary shaft (4);

wherein the rotor (6) is disposed in the outlet (10) below the impeller (5);

wherein water flowing through the water ejection port (30) rotates the impeller (5) and further rotates the rotor (6), thereby spraying the water out of the curved grooves (60) in water particles of annular pattern;

wherein the sliders (72) are configured to move along the annular rail (71); and wherein rotation of the impeller (5) and the ascending and descending of the sliders (72) along the annular rail (71) fluctuate the water flowing through the impeller (5), and the water flows through the rotor (6), thereby forming intermittent annular water sprays.

2. The water jet device for rotary massage of claim 1, wherein the impeller (5) and the rotor (6) are either secured together or formed integrally; and the rotation and the fluctuation of the impeller (5) drive the rotor (6) to ascend and descend, thereby changing a distance between the curved grooves (60) and a mouth of the outlet (10) and enlarging or reducing an annular area of the water sprays.

3. The water jet device for rotary massage of claim 2, wherein the outlet (10) has an inner diameter of 2–12mm, and the distance between the curved grooves (60) and the mouth of the outlet (10) is 2.5–8mm.

* * * * *